United States Patent [19]

Schemenauer

[11] Patent Number: 4,516,493

[45] Date of Patent: May 14, 1985

[54] APPARATUS FOR IMPRINTING AND CUTTING A TAPE OR RIBBON

[76] Inventor: Harold Schemenauer, 1943 Heatherwood Dr., Toledo, Ohio 43614

[21] Appl. No.: 587,555

[22] Filed: Mar. 8, 1984

Related U.S. Application Data

[63] Continuation-in-part of Ser. No. 465,536, Feb. 10, 1983, abandoned.

[51] Int. Cl.[3] ..... B41F 17/00

[52] U.S. Cl. ..... 101/27; 101/292; 101/382 MV; 101/391; 101/DIG. 19; 83/52; 83/248

[58] Field of Search ..... 101/27, 44, 382 MV, 101/391, 292, DIG. 19; 400/249; 83/52, 248, 622, 620, 530, 694

[56] References Cited

U.S. PATENT DOCUMENTS

| | | | |
|---|---|---|---|
| 1,258,944 | 3/1918 | Putnam | 101/27 |
| 1,978,790 | 10/1934 | Gould et al. | 101/27 |
| 2,035,957 | 3/1936 | Gabrielsen | 101/27 |
| 2,695,557 | 11/1954 | Draper | 101/382 MV |
| 3,031,951 | 5/1962 | Campbell | 101/DIG. 19 |
| 3,225,689 | 12/1965 | Fuchs, Jr. et al. | 101/44 |
| 3,280,737 | 10/1966 | Huck | 101/181 |
| 3,289,573 | 12/1966 | Apicella | 101/27 |
| 3,289,582 | 12/1966 | McKay | 101/329 |
| 4,052,935 | 10/1977 | Ward | 101/11 |
| 4,313,376 | 2/1982 | Swope et al. | 101/27 |
| 4,387,641 | 6/1983 | Kortick | 101/27 |

FOREIGN PATENT DOCUMENTS

| | | | |
|---|---|---|---|
| 2646336 | 4/1978 | Fed. Rep. of Germany | 400/249 |

*Primary Examiner*—Clifford D. Crowder
*Attorney, Agent, or Firm*—David D. Murray

[57] ABSTRACT

An apparatus for serially imprinting and cutting a tape such as an award ribbon includes a pneumatically actuated, heated imprinter and sequentially operated, pneumatically actuated cutter and trimmer. A stepping motor provides incremental movement of the ribbon and a ratchet drive mechanism coupled to the imprinter provides advancement of the foil or printing tape. The entire operation of the apparatus is under the control of a microprocessor which accepts information from the operator regarding ribbon length, imprint position and quantity and sequentially activates the various elements of the imprinting apparatus.

19 Claims, 11 Drawing Figures

APPARATUS FOR IMPRINTING AND CUTTING A TAPE OR RIBBON

This patent application is a continuation-in-part of U.S. patent application Ser. No. 465,536, filed Feb. 10, 1983, now abandoned.

BACKGROUND OF THE INVENTION

The invention relates generally to automatic imprinting equipment and more specifically to equipment for imprinting symbols, text, logotypes, indicia and other information on elongate tapes such as award ribbons and the like.

Mechanized equipment for the production of imprinted tape such as award ribbons and the like is commonplace due partly to the simplicity of the product and also to the quantities of awards typically presented at various races, contests, competitions and shows. Oftentimes, production runs of between one hundred and several thousand ribbons will be involved. Such numbers militate against manual production but also suggest that the most automatic and high-speed equipment are likewise undesirable and unnecessary in the majority of cases. Thus, while automated equipment is preferred, such equipment need not be of an extraordinarily complex and high-speed design.

Various machines have been designed for producing award ribbons, imprinted tape and similar products. Typically, such machines produce serial imprints of a design, symbol, text or indicia, along the length of a ribbon. Subsequent operations on other machines may then cut or trim the ribbon or tape as desired. Certain prior art devices have combined certain functions such that printing of a ribbon or tape may be followed directly by trimming, cutting or similar operations. Whether combined onto a single machine frame or performed on various machines which require the transfer of the ribbon from one machine to the next, a multifaceted problem which all known prior art devices have in common is what may be characterized as efficient, unattended production. Obviously, it is uneconomical for such a machine to require full-time supervision by an operator who simply observes the production of the machine. Nearly as obvious is the consideration that the machine not produce a multitude of defective products, if running unattended, which are costly from the standpoints of both a lost material and lost machine time resulting from the necessary repetition of the production run. By way of specific example, prior art machines have not incorporated any sensing means to determine the existence or non-existence of the ribbon or tape supplies. Thus, in spite of the fact that a tape supply may have become exhausted, the machine may continue to cycle, consuming valuable time and energy without producing a product until an operator corrects the problem. With regard to machines which utilize heat sensitive transfer foil, the same difficulty exists. That is, in prior art machines, when the foil tape has become exhausted, the machine typically will continue to cycle but produce no useable product until the foil tape deficiency is corrected. Furthermore, this problem may result in significant material loss since embossing of the award ribbon will continue but without transfer of the foil. The embossed image on the ribbon will render such unusable and necessitate destruction of whatever lengths of ribbon passed through the machine while the supply of foil tape was exhausted.

Another problem with such prior art imprinting machines relates generally to the same area of machine operation in production but more directly involves the components of the machine itself. Oftentimes, such sequential machines will operate from a control device which incorporates no feedback. That is, the machine controller simply issues commands by pneumatic or electric means to imprinting and cutting devices in a unidirectional manner and does not receive or manipulate data to confirm that such steps have, in fact, been executed. Again, this may result in production time loss and material waste inasmuch as the unattended machine may cycle for several minutes or longer before a malfunction is detected and corrected. Such machines also suffer from a lack of adjustability in that ribbon length, location of imprint, etc., may be unadjustable or may be adjusted only by mechanical means with substantial difficulty through repeated adjust and test procedures.

SUMMARY OF THE INVENTION

The instant apparatus is a device for serially imprinting, advancing and cutting tapes and ribbons such as award ribbons which includes a heated, pneumatically actuated imprinter which carries indicia, text, logotypes or similar information which is imprinted onto the ribbon. Such imprinting is achieved by providing a foil having a heat sensitive adhesive on one side and a heat resistant, preferably plastic substrate, on the other. Advance of such foil is mechanically coupled to operation of the pneumatically actuated imprinting mechanism such that only when a printing cycle has been completed will the foil advance. A second operating station includes a pneumatically activated cutting and trimming device which simultaneously cuts a serrated edge as well as a dovetail edge on the top of one ribbon and the bottom of an adjacent ribbon, respectively. Advance of the tape is controlled by a stepping motor which provides incremental movement of the tape both before and after the printing and cutting operations such that given a total length of tape may be produced, the imprinting may be produced at a given location along the length of the tape or multiple imprints may be made along the tape. The entire operation of the apparatus is under the control of a microprocessor which accepts information manually entered by an operator regarding the ribbon length, imprint position or positions and total quantity of ribbons produced. Variable width guides for the tape permit the device to accept a broad range of widths while simple material paths permit rapid and simplified loading and reloading of the machine. Mechanical and electronic feedback devices provide information to the microprocessor and mechanical components of the device to ensure that each step of each cycle of the machine is properly completed before the next cycle step is undertaken. Furthermore, the machine includes sensors which monitor the supply of both the tape or ribbon and foil and terminate operation should the supply of either of these materials be exhausted during the course of production.

Thus it is an object of the instant invention to provide a unitary machine which is capable of producing complete printed and cut award ribbons, tapes and similar products.

It is a further object to the instant invention to provide an imprinting machine which is readily adjustable to fabricate various ribbon lengths, imprint positions and feed rates per cycle.

It is a still further object of the instant invention to provide an imprinting machine which includes feedback controls to monitor the production of imprinted tape.

It is a still further object of the instant invention to provide an imprinting machine controlled by a microprocessor which is capable of multiple printing of text, logotype and other designs upon a length of ribbon or tape.

Still further objects and advantages of the instant invention will become apparent by reference to the following description of the preferred embodiment of the appended drawings.

DESCRIPTION OF THE PREFERRED EMBODIMENT

Figure 1:
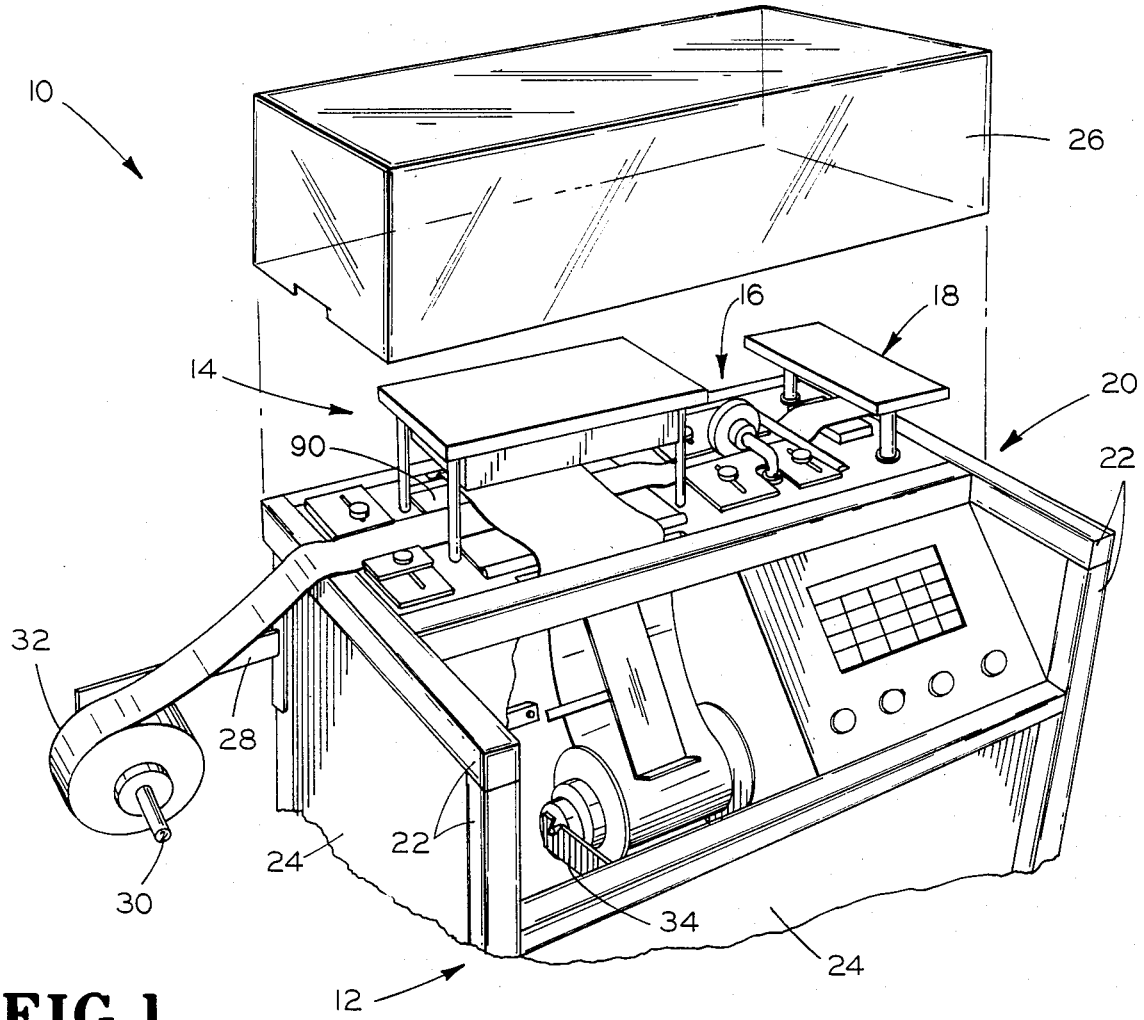
FIG. 1 is a perspective view of a tape imprinter according to the instant invention.
Figure 2:
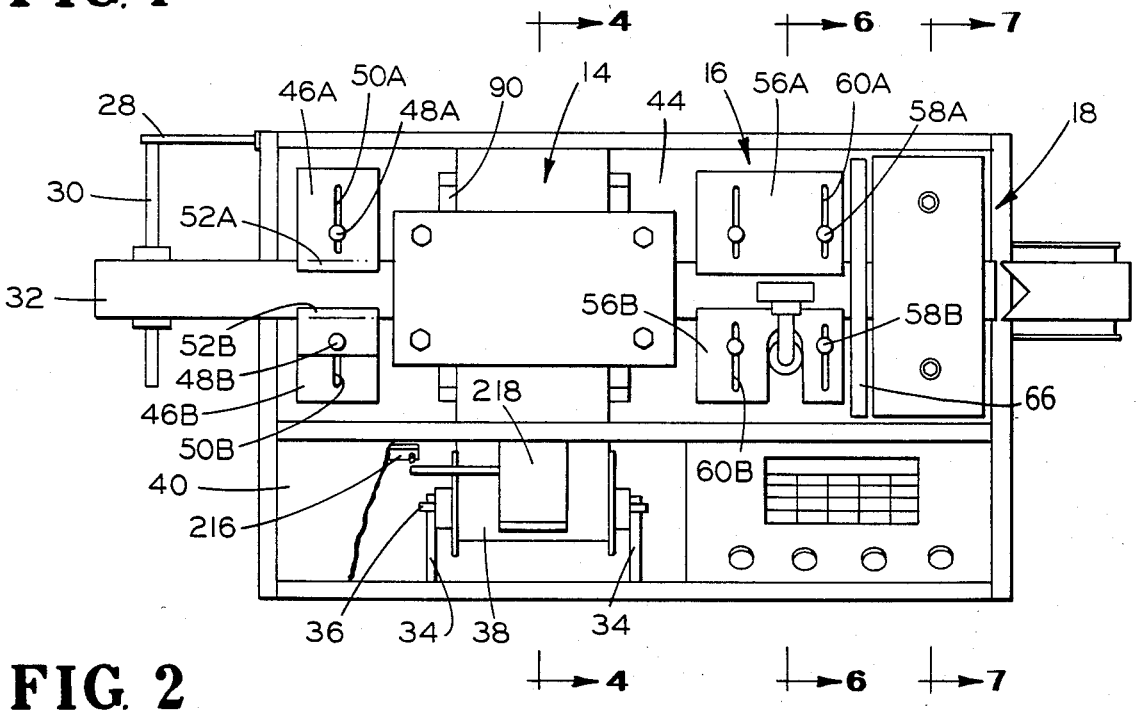
FIG. 2 is a top, plan view of a tape imprinter according to the instant invention.

Referring now to FIGS. 1 and 2, a tape imprinting apparatus according to the instant invention is illustrated and generally designated by the reference numeral 10. The imprinting apparatus 10 comprises a frame assembly 12, an imprinting assembly 14, an advancing assembly 16, a cutting assembly 18, and a control assembly 20.

The frame assembly 12 generally comprises a plurality of structurally rigid square or rectangular beams 22 which are rigidly secured together by welding or other suitable fastening means. For reasons of aesthetics and safety, sidewall panels 24 are disposed between the beams 22 but are removeable in order to facilitate access to and service of the components within the apparatus 10. Safe operation of the apparatus 10 is enhanced by the utilization of a transparent rectangular cover 26 which protects the various assemblies of the apparatus 10. Preferably, the cover 26 actuates an interlock switch (not illustrated) which inhibits operation of the apparatus 10 when the cover 26 is removed from the upper part of the frame assembly 12. Secured to one of the vertical beams 22 is a support arm 28 having an elongate horizontally disposed shaft 30 which receives a roll of ribbon or tape 32 or similar material which is utilized in the apparatus 10. Disposed within the frame assembly 12 is a pair of parallel support arms 34 which receive a transversely disposed shaft 36. The shaft 36 in turn supports a roll of imprinting foil 38 or similar material. The support arms 34, the shaft 36 and the roll of foil 38 may be disposed behind a hinged panel 40 which is secured to one of the horizontal beams 22 of the frame assembly 12.

Secured to the beams 22 constituting the uppermost portion of the frame assembly 12 is a chassis 44 to which the imprinting, advancing and cutting assemblies 14, 16 and 18, respectively, and other subassemblies are secured. Specifically, a first pair of adjustable guides 46A and 46B are selectively secured to the chassis 44 by a respective pair of threaded thumbscrews 48A and 48B which extend through a respective pair of elongate slots 50A and 50B into chassis 44. The guides 46A and 46B each include an overhanging lip 52A and 52B, respectively, which cooperatively define a path for the ribbon or tape 32. The guides 46A and 46B may be readily adjusted to accept varying widths of the ribbon or tape 32 as well as fix its position by loosening the threaded thumbscrews 48A and 48B, appropriately moving the guides 46A and 46B and resecuring the threaded thumbscrews 48A and 48B. A second pair of guides 56A and 56B are disposed generally coincident the advancing assembly 16 and each cooperates with opposed pairs of threaded thumbscrews 58A and 58B which extend through opposed pairs of elongate slots 60A and 60B into the chassis 44. Each of the second pair of guides 56A and 56B likewise includes an overhanging lip 62A and 62B which cooperatively define a path for the ribbon or tape 32. The guides 56A and 56B are, in a fashion similar to the guides 46A and 46B, moveable toward or away from one another to provide an adjustable width path for the ribbon or tape 32 and to maintain it in a desired location as it traverses the apparatus 10. Positioned generally between the pairs of guides 56A and 56B and the cutting assembly 18 is a horizontally disposed guide bar 66 which is spaced from the chassis 44 and defines a generally elongate slot (not illustrated) directly above the chassis 44 through which the ribbon or tape 32 may be threaded in order to maintain same in a proper vertical position.

Figure 3:
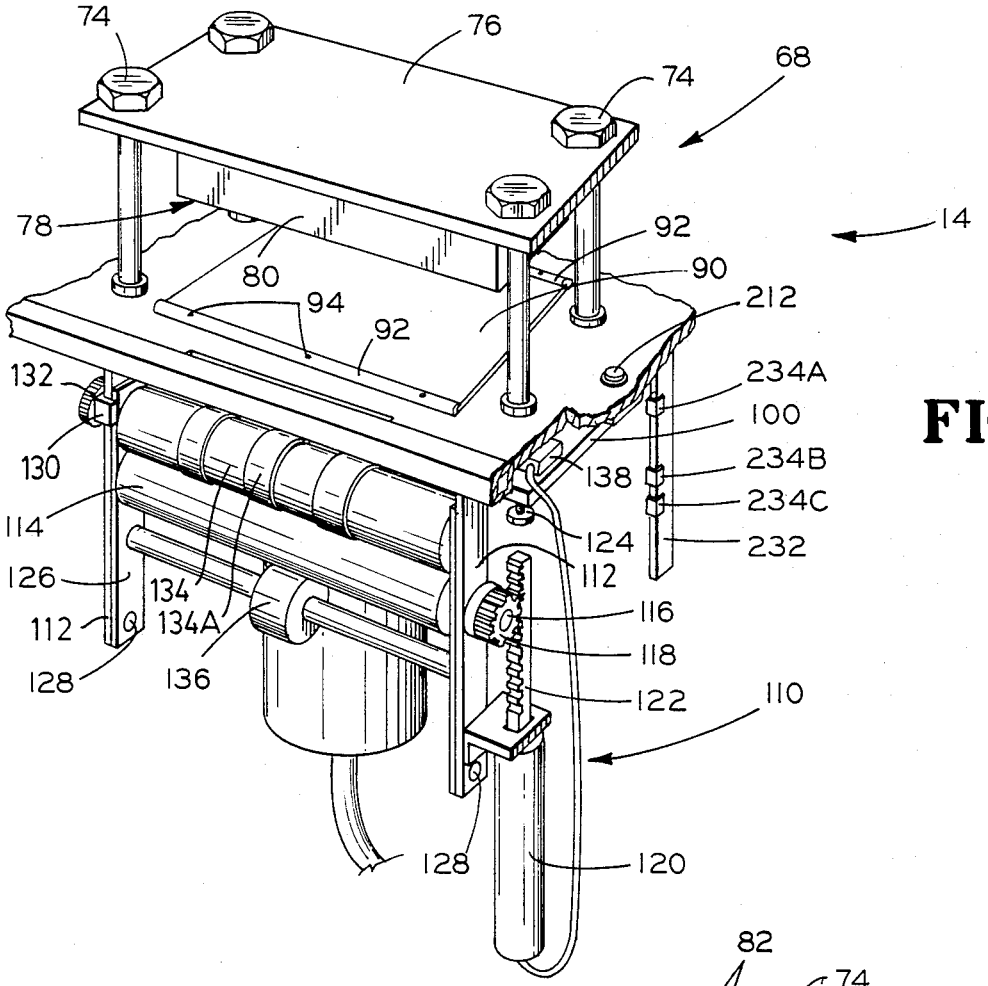
FIG. 3 is a perspective view of the imprinting assembly of a tape imprinter according to the instant invention.
Figure 4:
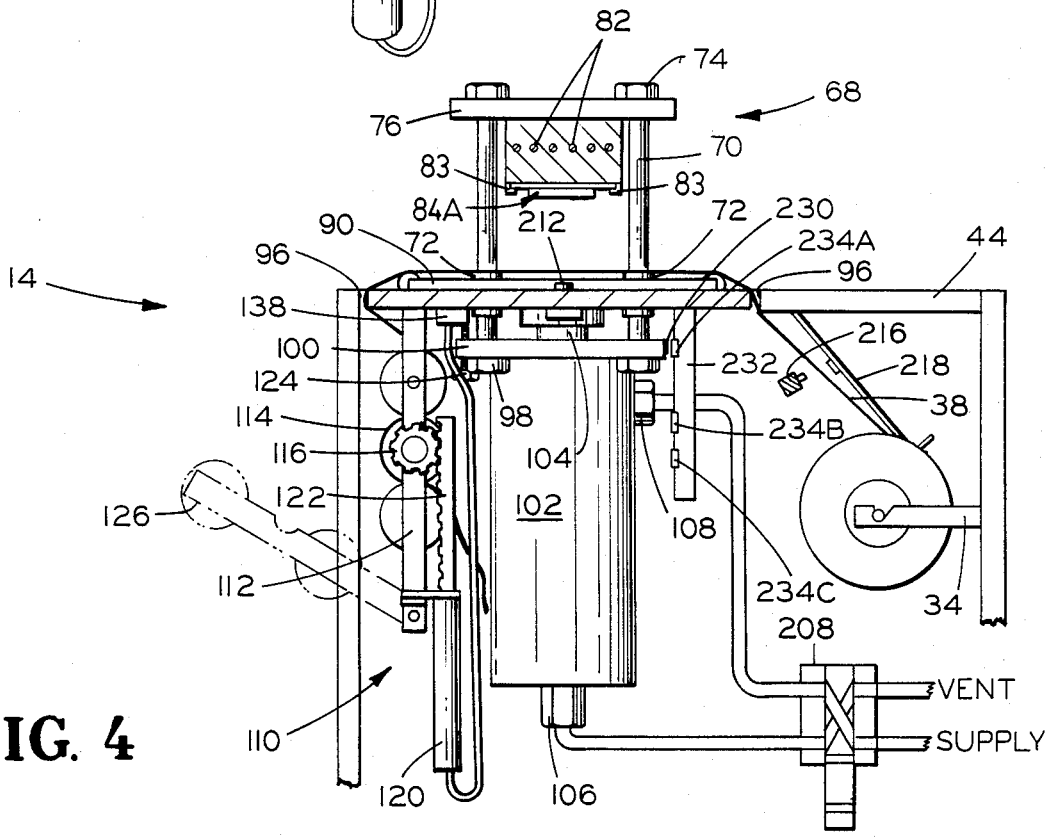
FIG. 4 is a full, sectional view of a tape imprinter according to the instant invention taken along line 4—4 of FIG. 2.

Referring now to FIGS. 3 and 4, the imprinting assembly 14 is seen to include an imprinting shuttle 68 having a plurality of cylindrical guides 70 which are slidably received within a like plurality of bushings 72 which are in turn secured to the chassis 44. To the upper termini of the guides 70 is rigidly secured by threaded fasteners 74 or other suitable means a rectangular horizontal top plate 76. Disposed on the underside of the rectangular top plate 76 is a heater assembly 78 which generally includes a metal block 80 within which is embedded an electric heating element 82. The metal block 80 functions as a thermal mass which uniformly disperses the heat generated by the heating element 82 across an associated printing assembly. A thermostat (not illustrated) secured to the block 80 senses the temperature thereof and controls the application of electrical energy to the heating element 82 to maintain a constant desired temperature of the block 80 and printing assembly. The metal block 80 also includes a pair of L-shaped parallel guides 83 which function as a slide-in retaining mechanism facilitating rapid and simple installation and removal of a variety of associated printing assemblies which will be described directly below.

Figure 5A:
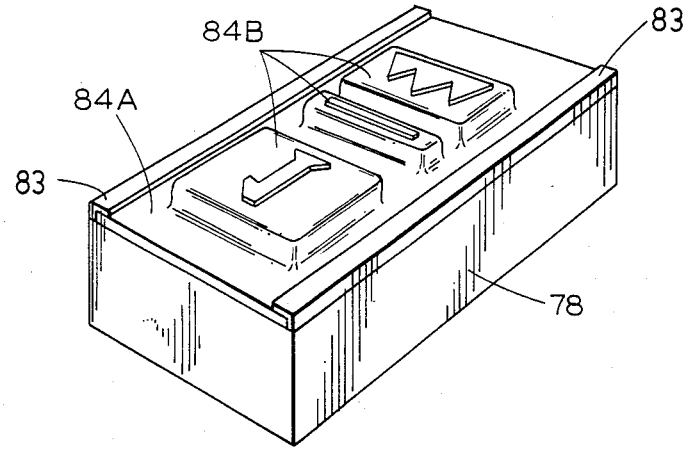
FIG. 5A is a fragmentary, perspective view of a portion of the imprinting assembly having a die or printing plate positioned thereupon.
Figure 5B:
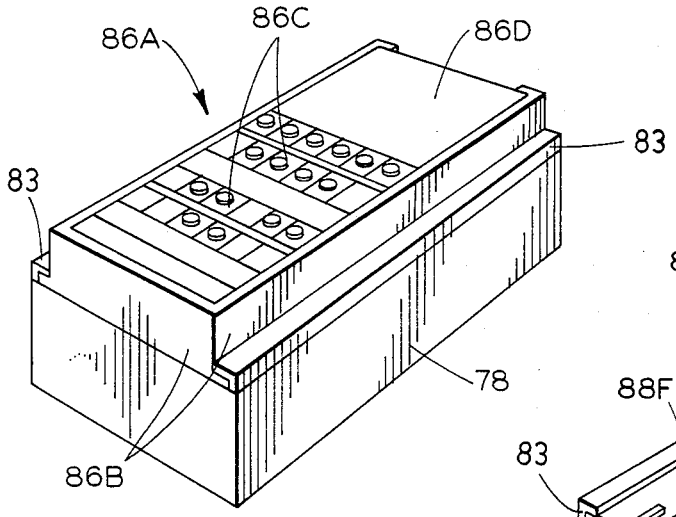
FIG. 5B is a fragmentary, perspective view of a portion of the imprinting assembly having a foundry or set type printing block disposed thereon.
Figure 5C:
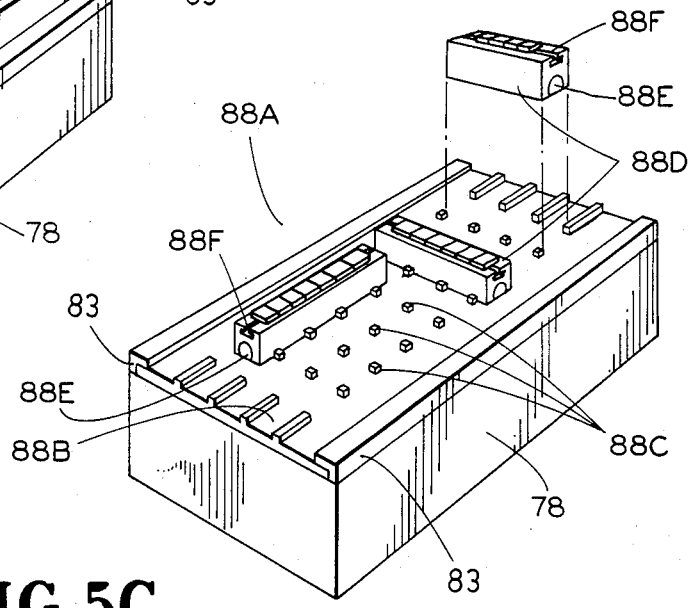
FIG. 5C is a fragmentary, perspective view of a portion of the imprinting assembly having a novel, readily interchangeable type holding device disposed thereon.

Referring now to FIG. 5A, an etched die or printing plate 84A is illustrated in position on the metal block 80. The etched die 84A is relatively thin and includes various text, insignia and other indicia 84B which is desired to be imprinted upon the tape 32 by the apparatus 10. Typically such die or printing plate 84A with the indicia 84B will be cast as an integral unit, simply slid into the L-shaped parallel guides 83 and retained there by suitable fasteners (not shown). FIG. 5B illustrates a second style of printing assembly which is also readily received by the guides 83 disposed on the block 80 of the imprinting assembly 14. Here, a type carrier 86A accepts foundry, Ludlow type or other set type having a conventional height which is substantially thicker than the printing plate 84A discussed directly above. The carrier 86A includes appropriate sidewalls and end walls 86B within which are disposed various moveable type components 86C and spacers 86D. The type carrier 86A permits the assembly of various insignia, text and indicia generally at the site of the imprinting apparatus 10. The use of the type carrier 86A thus facilitates rapid fabrication of a printing assembly that is generally utilized for lower volume runs which do not justify the preparation of an etched die printing plate 84A as discussed directly above. As will be discussed below, the imprinting assembly 14 and specifically the imprinting shuttle 68 include sensing devices which appropriately control the vertical traverse of the imprinting shuttle 68 in order to ensure proper contact between the printing assemblies here discussed and the tape 32. With reference now to FIG. 5C, a novel, rapidly changeable printing assembly 88A is illustrated. Here, a thin, ferrous plate 88B having a square matrix of projections 88C disposed uniformly across its face provides a mounting base for rapidly interchangeable type carriers 88D. The illustrated arrangement of the projections 88C facilitates rapid and positive registration of the type carriers 88D in vertical and horizontal axes. Other matrix patterns may, of course, be utilized to provide accurate angular registration at any selected angle or angles. Each of the type carriers 88D includes a magnet 88E disposed in a complementary slot adjacent the rear of the type carrier 88D. The type carrier 88D also includes a suitable open through slot 88F for receiving appropriate type. The type carriers 88D may be arranged in any desired vertical, horizontal or other arrangement on the plate 88B and readily retained there by the magnets 88E and, of course, just as readily removed.

With reference now to FIGS. 3 and 4, it will be appreciated that disposed directly below the printing plate 84 and secured to the chassis 44 is a printing platen 90. The printing platen 90 is fabricated of any suitable heat-resistant elastomeric material. The platen 90 is maintained in the desired location by a pair of notched elongate retaining bars 92. The retaining bars 92 are preferably secured to the chassis 44 by threaded fasteners 94 such that they may be readily removed and the platen 90 quickly inspected and serviced. A pair of parallel slots 96 are disposed in the chassis 44 on opposite sides of the platen 90 and provide passageways through which the foil 38 is threaded.

The lower ends of the guides 70 are commonly and rigidly secured by threaded fasteners 98 or other suitable means to a rectangular horizontal bottom plate 100. Disposed generally centrally between the guides 70 and along an axis parallel thereto is a pneumatic cylinder 102 having a piston 104. The pneumatic cylinder 102 is secured to the underside of the horizontal bottom plate 100 and the piston 104 abuts and is secured to the underside of the chassis 44. The cylinder 102 is a conventional double acting design in which the piston 104 extends upon the application of compressed air to a bottom port 106 and retracts upon the application of compressed air to a top port 108.

The imprinting assembly 14 also includes a foil advancing mechanism 110. The foil advancing mechanism 110 includes a pair of spaced apart depending supports 112 which are secured to the underside of the chassis 44. Disposed transversely of the supports 112 is a drive roller 114 which is mounted upon a stub shaft 116 which is in turn rotatably disposed within suitable bearings or bushings (not illustrated) in the supports 112. The stub shaft 116 includes a terminal portion which extends beyond one of the supports 112. To such terminal portion of the shaft 116 is disposed a one-way or over-running clutch and pinion gear assembly 118. Viewed from the end of the stub shaft 116 having the clutch and gear assembly 118, it will transfer rotary energy to the roller 114 when the pinion gear is driven in a counter-clockwise direction. Conversely, when the pinion gear of the assembly 118 is driven in a clockwise direction, the pinion gear will free wheel upon the shaft 116 and no energy will be transferred between the pinion gear of the assembly 118 and the roller 114. A single acting, spring return pneumatic piston and cylinder assembly 120 is also secured to the support 112 adjacent the clutch and pinion gear assembly 118 and includes a gear rack 122 which meshes with the pinion gear of the assembly 118. As the piston extends from the piston and cylinder assembly 120 and the gear rack 122 translates upwardly, the assembly 118 and the drive roller 114 will rotate counter-clockwise whereas downward translation of the gear rack 122 will result in clockwise rotation of the pinion gear of the assembly 118 but no rotation of the roller 114. An adjustable threaded stop 124 is positioned on the underside of the chassis 44 in alignment with the gear rack 122 and permits adjustment of the upper limit of translation of the gear rack 122. The angular rotation of the roller 114 and thus the linear feed of the foil 38 per stroke may be adjusted by advancing or retracting the threaded stop 124.

The foil advancing mechanism 110 also includes a pair of parallel arms 126 disposed within and parallel to the supports 112. Each of the arms 126 are pivotally secured to an adjacent one of the supports 112 by a respective pair of pivot pins 128 which extend from the supports 112. A U-shaped locking bracket 130 extends from one of the arms 126 generally about the adjacent one of the supports 112 and may be selectively engaged by a thumbscrew 132 to retain the arms 126 parallel to the supports 112, that is, in the position illustrated in FIG. 3. The pivotally disposed arms 126 support a first idler or pressure roller 134 and a second idler or pressure roller 136. Both the first roller 134 and the second roller 136 are mounted for free rotation on axes parallel to the axis of drive roller 114 and are constructed of suitable elastomeric material. The rollers 134 and 136 create a sinuous path for the foil 38 around the drive roller 114, having a minimum wrap of 180°; thereby ensuring positive drive of the foil 38 by the drive roller 114. The first pressure roller 134 may include traction bands 134A of a generally softer elastomeric material which further improve the drive characteristics. The pivotal mounting of the rollers 134 and 136 permits them to be moved to the position illustrate in dashed lines in FIG. 4 to facilitate threading of the foil 38 through the foil advancing mechanism 110. From the foregoing, it will be appreciated that the paths or axes of travel of the ribbon or tape 32 and foil 38 are disposed at right angles to one another. They intersect in this orientation at and in the vicinity of the platen 90 as illustrated in FIGS. 1 and 2, a configuration which significantly simplifies both the apparatus 10 itself and its operation.

A mechanically actuated three-way pneumatic control valve 138 is secured to the underside of the chassis 44. The pneumatic valve 138 is aligned with and actuated by the rectangular horizontal bottom plate 100. The normally open port of the control valve 138 is connected to a supply line which provides compressed air at typical shop pressures of between 50 and 80 P.S.I. The normally closed port of the control valve 138 is vented to atmosphere and the common port is connected to the piston and cylinder assembly 120. Inasmuch as the control valve 138 is actuated when the printing shuttle assembly 68 is in its quiescent state as illustrated in FIG. 3, it will be appreciated that the control valve 138 in this condition vents the cylinder of the piston and cylinder assembly 120 to atmosphere and provides compressed air thereto when the control valve 136 is deactivated (i.e., placed in its normal mode) by downward movement of the imprinting shuttle 68.

Figure 6:
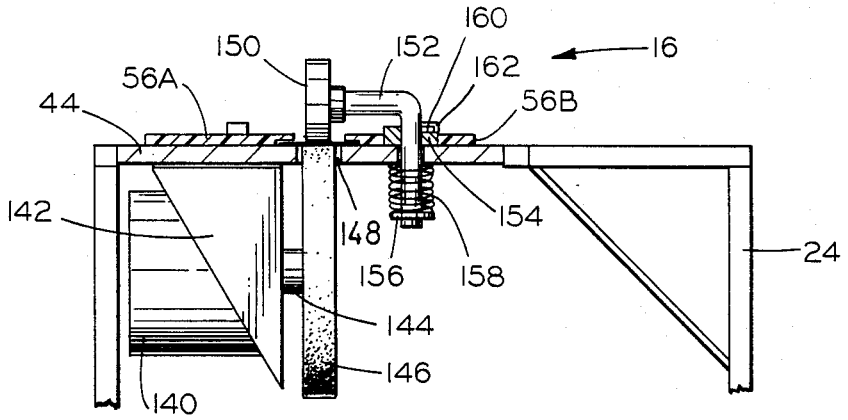
FIG. 6 is a fragmentary, sectional view of the tape advancing assembly of a tape imprinter according to the instant invention taken along line 6—6 of FIG. 2.

Referring now to FIGS. 2 and 6, the advancing assembly 16 is seen to include a conventional stepping motor 140 which is secured to the underside of the chassis 44 by means of an appropriate mounting bracket 142 or similar structure. The stepping motor 140 includes an incrementally rotatable output shaft 144 which receives a relatively large diameter drive wheel 146. The drive wheel 146 is fabricated of a substantially rigid non-wearing material such as nylon and may include a roughened, traction increasing peripheral surface. The drive wheel 146 extends through a slot 148 in the chassis 44 and is disposed substantially flush with the upper surface of the chassis 44 and generally cehtered both transversely and longitudinally between the guides 56A and 56B. A selectively engageable idler or friction wheel 150 is disposed directly above the drive wheel 146 on an axis of rotation which is preferably coincident with a vertical plane containing the axis of rotation of the stepping motor output shaft 144 and drive wheel 146. The friction wheel 150 is rotatably disposed upon an L-shaped arm 152 which in turn is seated within a bushing 154 secured to the chassis 44. Between the lower surface of the chassis 44 and a retaining washer 156 secured to the arm 152 is disposed a compression spring 158. The compression spring 158 provides a downward force which biases the friction wheel 150 and the ribbon or tape 32 toward the drive wheel 146 thus facilitating frictional engagement and translation of the ribbon or tape 32 by the drive wheel 146. Adjacent the upper face of the bushing 154 and radially extending from the arm 152 is an indexing pin 160. The pin 160 seats within a complimentarily formed radially extending slot 162 in the upper surface of the bushing 154 and maintains the friction wheel 150 in operative alignment with the drive wheel 146 as illustrated. The subject mounting arrangement permits ready movement of the friction wheel 150 out of the path of the ribbon and tape 32 to facilitate loading or inspection of the apparatus 10 as well as rapid redeployment of the friction wheel 150 to the operating position.

Figure 7:
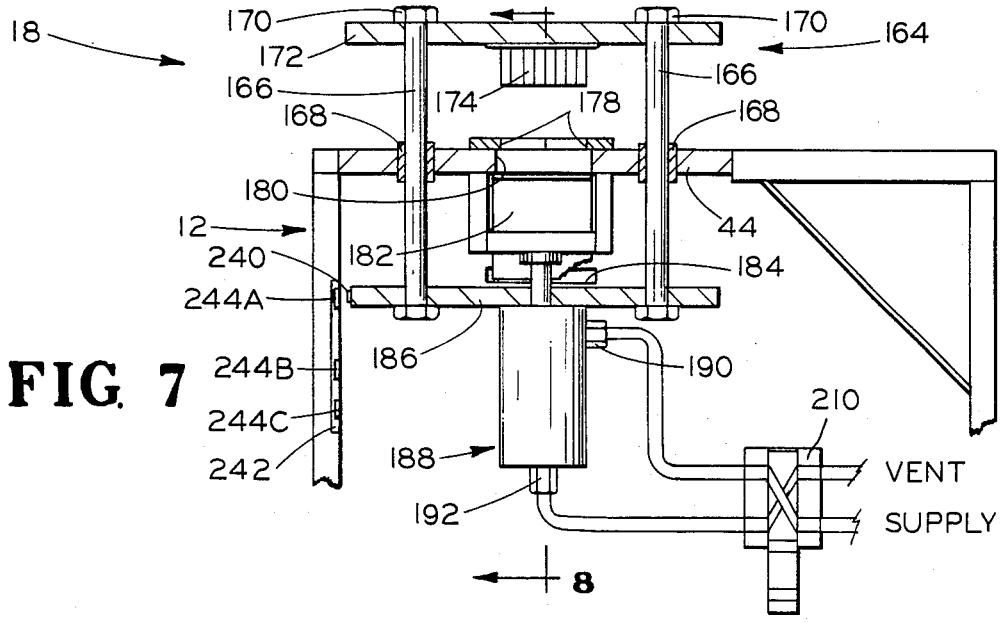
FIG. 7 is a full, sectional view of a cutting assembly according to the instant invention taken along line 7—7 of FIG. 2.
Figure 8:
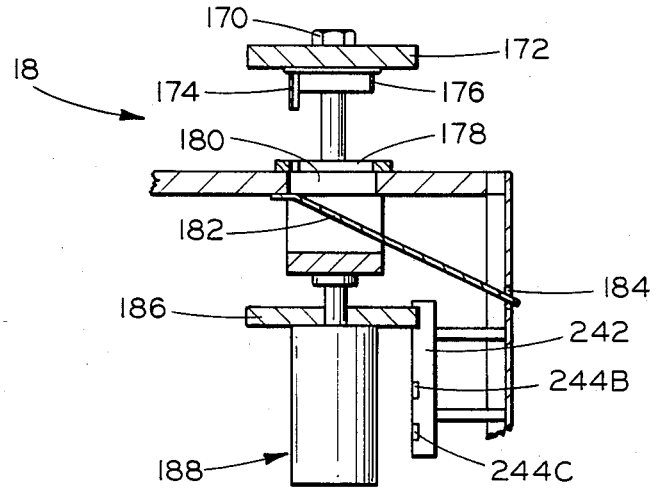
FIG. 8 is a full, sectional view of a cutting assembly according to the instant invention taken along line 8—8 of FIG. 7.

Referring now to FIGS. 1, 7 and 8, the cutting assembly 18 includes a cutting shuttle 164 which comprises a pair of parallel cylindrical guides 166. The guides 166 are slidably disposed within a complementary pair of bushings 168 secured to the chassis 44 of the frame assembly 12. To the upper termini of the guides 166 is rigidly secured, by threaded fasteners 170 or other suitable means, a rectangular horizontal top plate 172. To the lower surface of the top plate 172 is secured a ribbon cutter having a long, i.e., tall, serrated cutting edge 174 and a shorter, dovetail cutting edge 176. Disposed in vertical alignment directly below the serrated cutting edge 174 and dovetail cutting edge 176 and secured to the chassis 44 is a complementarily shaped die 178 having appropriate serrated and dovetail edges which cooperate with the edges 174 and 176, respectively. Various other configurations of cutting and trimming dies may, of course, be installed as required. An aperture 180 in the chassis 44 permits scraps of the ribbon or tape 32 to pass through the die 178, down a chute 182 and through an aperture 184 in the sidewall panel 24 of the apparatus 10. The lower termini of the guides 166 are rigidly secured to a horizontal rectangular bottom plate 186 by suitable fasteners. Disposed generally centrally of the rectangular horizontal bottom plate 186 and aligned therewith is a piston and cylinder assembly 188. The piston of the assembly 188 is secured to a subchassis which is in turn secured to the underside of the chassis 44 and the cylinder of the assembly 188 is mounted upon the horizontal bottom plate 186. The piston and cylinder assembly 188 is a conventional double acting device. When compressed air is supplied to an upper port 190 of the piston and cylinder assembly 188, the cutting shuttle 164 translates downwardly, engaging the cutting edge 174 or cutting edges 174 and 176 with the die 178 thereby cutting and trimming, as appropriate, the tape 32. Whether only the cutting edge 174 or both edges 174 and 176 engages the die 178 depends upon the extent of vertical traverse of the cutting shuttle 164, the control of which will be described below. When compressed air is vented from the upper port 190 and supplied to a lower port 192 of the piston and cylinder assembly 188, the cutting shuttle 164 returns to the position illustrated in FIG. 7.

Figure 9:
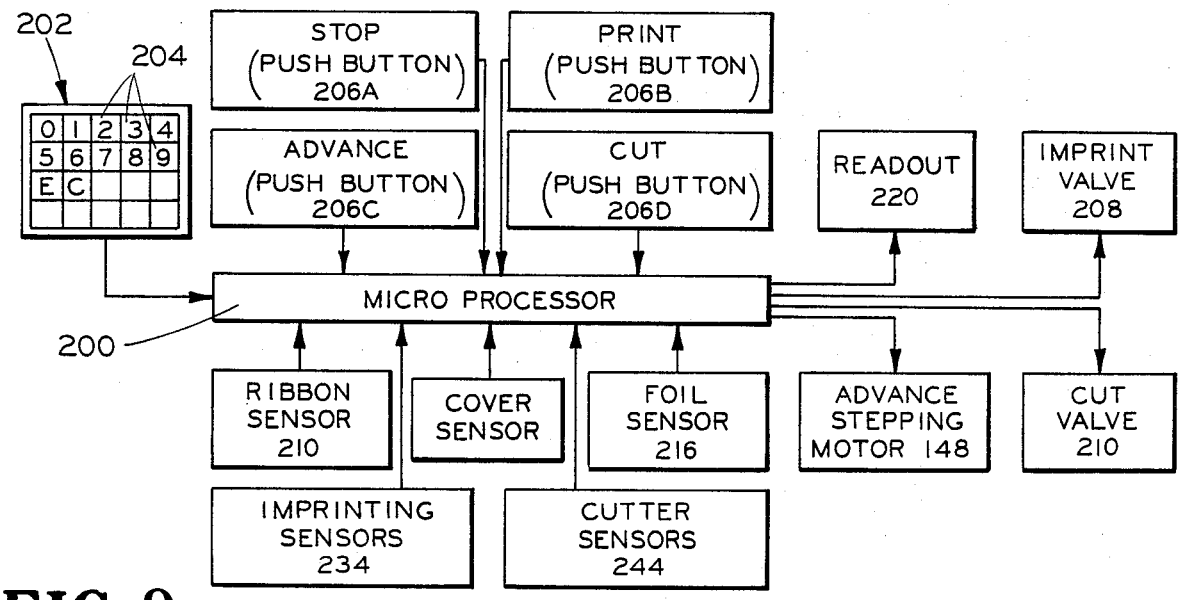
FIG. 9 is a block diagram of a programmable control of a tape imprinter according to the instant invention.

Referring now to FIGS. 1 and 9, the control assembly 20 includes a microprocessor 200 which receives data, processes it and provides outputs which control the overall operation of the apparatus 10. Specifically, the control assembly 20 includes a keyboard 202 having a plurality of numerical and address keys 204 which permit entry of addresses and instructions such as tape length, imprint position and production quantity as well as the actual numerical quantity associated therewith. The output of the keyboard assembly 202 is provided to the microprocessor 200. The microprocessor 200 also receives information from four manually activatable pushbutton switches 206A, 206B, 206C, and 206D. The pushbutton switch 206A is a function override which, through the microprocessor 200, immediately terminates any ongoing operation of the apparatus 10 and returns it to a quiescent state. The pushbutton switch 206B, through the microprocessor 200 and a four way electro-pneumatic valve 208, activates the cylinder 100 and the piston 102 to cause the printing shuttle 68 to cycle. The pushbutton switch 206C, through the microprocessor 200, provides an output to the stepping motor 148 which incrementally advances the ribbon or tape 32. The pushbutton switch 206D, through the microprocessor 200 and a four way electro-pneumatic valve 210, activates the piston and cylinder assembly 188 to cause the cutting shuttle 164 to cycle.

Referring now to FIGS. 3 and 7, the microprocessor 200 also receives a signal from a sensor 212 such as a microswitch or similar device which monitors the presence and thus supply of ribbon or tape 32 as it enters the imprinting assembly 14. The housing of the sensor 212 is preferably secured to the underside of the chassis 44 and extends through the chassis 44.

Referring now to FIGS. 2, 4 and 7, the microprocessor 200 similarly receives a signal from a sensor 216 such as a microswitch or similar device which monitors the presence and thus supply of the foil 38. The sensor 216 is secured to the lower surface of the chassis 44 and includes a sensing arm 218 which lightly rests against the roll of foil 38 as those familiar with such devices will readily appreciate. As noted previously, an interlock switch which is activated by the cover 26 also provides a signal to the microprocessor 200 which enables or inhibits operation of the apparatus 10. Such information is also provided to the microprocessor 200. In addition to the outputs to the drive components of the printing assembly 14, the advancing assembly 16 and cutting assembly 18, the microprocessor 200 also provides information and data to a digital readout 220. The readout 220 confirms the entry of numerical data as well as provides certain information relating to the overall operation of the apparatus 10 through alpha-numeric coded displays.

The microprocessor 200 also receives signals from sensors providing information about the operation of the imprinting assembly 14 and the cutting assembly 18. The imprinting assembly 14 (illustrated in FIG. 4) includes a reflective device such as a mirror 230 secured to the horizontal bottom plate 100 and an elongate bracket 232 which is secured to the underside of the chassis 44 and extends along the axis of travel of the imprinting shuttle 68. The bracket 232 supports three optical sensors 234A, 234B and 234C which are mounted to correspond to various positions of the imprinting shuttle 68. The sensor 234A is positioned at the rest or home position and provides a signal to the microprocessor 200 that the imprinting shuttle 68 is in this position. The sensor 234B is positioned at the set type printing position, that is, a position achieved by limited travel of the imprinting shuttle 68 which takes into account the thickness of the set type carrier 86A on the printing assembly 88A such that proper imprinting force is applied to the ribbon or tape 32. The sensor 234C is positioned at the printing plate position, that is, a position achieved by full travel of the imprinting shuttle 68 which accommodates and compensates for the thinness of the printing plate 84A and provides proper imprinting force. A selector switch (not illustrated) provides information to the microprocessor 200 regarding the appropriate operator selected travel of the imprinting shuttle 68 which matches the printing assembly selected. Likewise, the cutting assembly 18 (illustrated in FIGS. 7 and 8) includes a reflective device such as a mirror 240 secured to the horizontal bottom plate 186 and an elongate bracket 242 which is secured to the underside of the chassis 44 and extends along the axis of travel of the cutting shuttle 164. The bracket 242 supports three optical sensors 244A, 244B and 244C which are mounted to correspond to various positions of the cutting shuttle 164. The sensor 244A is positioned at the rest or home position, the sensor 244B represents a first cutting position and sensor 244C represents a second cutting position. Given appropriate vertical separation of the components of the serrated cutting edge 174 and dovetail cutting edge 176, the first cutting position determined by the sensor 244B will bring into cutting contact with the die 178 only the serrated cutting edge 174 to effect a serrated, transverse cut whereas the second cutting position determined by the sensor 244C will bring into cutting contact with the die 178 both the serrated and dovetail cutting edges 174 and 176, respectively, to effect both serrated and dovetail cuts. A selector switch (not illustrated) provides information regarding the appropriate operator selected travel of the cutting shuttle 164 to the microprocessor 200.

The microprocessor 200 also provides automatic enable or activate signals to the four way electro-pneumatic valve 208 (illustrated in FIG. 4) associated with the cylinder 100 of the imprinting assembly 14 and the four way electro-pneumatic valve 210 (illustrated in FIG. 7) associated with the piston and cylinder assembly 188 of the cutting assembly 18. Activation of the valves 208 and 210 by the microprocessor 200 supplies compressed air to one side of the piston of the associated assembly while venting the other side to atmosphere causing translation of the piston. Deactivation of the valves reverses the foregoing actions.

Operation of the imprinting apparatus 10 is straightforward. First of all, an appropriate printing block must be installed on the heater block 78 of the imprinting shuttle 68 and the imprinting shuttle travel selector switch is appropriately set. The cutting shuttle travel selector switch may also be set at this time. Next, rolls of ribbon or tape 32 and imprinting foil 38 must be fitted to the apparatus 10 and threaded therethrough. With regard to the ribbon or tape 32, the threading operation consists of generally positioning it across the chassis 44 and adjusting the pairs of guides 46A and 46B and 56A and 56B to the appropriate width to receive and guide it. With regard to the guides 56A and 56B, this operation is facilitated by temporarily pivoting the friction wheel 150 out of contact with the drive wheel 146. As FIGS. 1 and 2 render manifest, the tape 32 must be threaded underneath the guide bar 66. FIG. 4 best illustrates the threading of the foil 38 through the pair of slots 96 in the chassis 44 and across the printing platen 90. The thumbscrew 132 is then loosened to free the pivotally mounted pressure rollers 134 and 136 such that the foil 38 may be threaded around the drive roller 114 and the adjacent pressure rollers 134 and 136.

Next, data is entered into the microprocessor 200 through the keyboard assembly 202. Such data includes the length of each ribbon to be cut, the location on the ribbon of the imprint or of multiple imprints and the total number of ribbons or other pieces to be produced. The microprocessor 200 preferably includes read only memory (ROM) which stores standard data such as the most common ribbon length and most common imprint position, for example, if desired. Should a pilot or test cycle be desired, the apparatus 10 may be cycled through its individual operations by sequentially depressing the print pushbutton switch 206B, the advance pushbutton switch 206C and the cut pushbutton switch 206D. Should difficulties be encountered when the machine is operating automatically, the operation of the apparatus 10 may be immediately terminated by pressing the stop pushbutton switch 206A.

A complete cycle of the apparatus 10 includes downward advance of the imprinting shuttle 68 to drive the heated printing assembly against the platen 90. As the shuttle 68 advances, the control valve 138 is deactivated and the piston and cylinder assembly 120 advances the foil 38 a preselected distance. Upon completion of the imprinting process, the printing shuttle 68 returns to its rest position and activates the control valve 138 and the piston and cylinder assembly 120 returns to its home position illustrated in FIGS. 3 and 4. Subsequent to the printing operation, the stepping motor 140 is activated to advance the ribbon or tape 32 a preselected distance. Subsequent to such advance, the microprocessor 200 activates the piston and cylinder assembly 188 which cuts the tape 32 in the desired location. As noted previously, the sensors 244A, 244B and 244C provide position information to the microprocessor 200 of the operation of the cutting assembly 18 which permits the microprocessor 200 to total the number of operations of the cutting assembly 18 and thus the total number of produced ribbons or similar products.

The foregoing disclosure is the best mode devised by the inventor for practicing this invention. It is apparent, however, that devices incorporating modifications and variations will be obvious to one skilled in the art of printing apparatus. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. A tape imprinting apparatus comprising, in combination:

means for imprinting indicia on a tape including a printing assembly, means for providing heat to said printing assembly, a platen spaced from and parallel to said printing assembly, first means for reciprocably translating said printing assembly along an axis normal to said platen and into imprinting contact with a tape disposed on said platen;

first means for advancing the tape along a first axis including a first drive roller, a first idler roller and first means for rotating said first drive roller;

at least one pair of guide means having adjustable separation along an axis transverse to said first axis for guiding said tape along said first axis;

second means for advancing a printing foil generally along a second axis normal to said first axis including a second drive roller, a second idler roller and second means for unidirectionally rotating said second drive roller, means responsive to said imprinting means for cycling said second advancing means; and means for cutting said tape including a first tape cutting mechanism having a first cutting pattern, a second cutting mechanism having a second cutting pattern, and means for selectively activating said first cutting mechanism or said first and said second cutting mechanisms to cut such tape according to said cutting patterns.

2. The apparatus of claim 1 further including a sequencing means for providing operating commands to said printing means, said first advancing means and said cutting means.

3. The apparatus of claim 1 wherein said imprinting means includes a pneumatic cylinder.

4. The apparatus of claim 1 wherein said first advancing means includes a stepping motor means for driving said first drive roller.

5. The apparatus of claim 1 wherein said first idler roller of said first advancing means has an axis of rotation and is pivotally disposed about an axis normal to said axis of rotation.

6. The apparatus of claim 1 wherein said second advancing means includes a bidirectionally translating means for driving a gear rack, a pinion engaged by said gear rack and an overrunning clutch operably interposed between said pinion and said second drive roller.

7. The apparatus of claim 1 wherein said printing assembly includes a planar mounting structure having a plurality of positioning projections disposed on one face, at least one type receiving structure having magnetic means for selectively securing said type receiving structure to said planar mounting structure.

8. The apparatus of claim 1 wherein said cutting means further includes a shuttle assembly for mechanically coupling said translatable segment to said reciprocably translating means, said translating means including a pneumatic piston and cylinder assembly, and means for sensing the position of said shuttle assembly.

9. The apparatus of claim 1 further including means for supplying a substantially continuous length of tape, means for supplying a substantially continuous length of foil and means for sensing the absence of said tape and said foil and for inhibiting operation of said apparatus in the absence of either said tape or said foil.

10. The apparatus of claim 1 wherein said second advancing means further includes means for adjusting the angular rotation of said second drive roller.

11. The imprinting apparatus of claim 1 wherein said imprinting means and said cutting means includes position sensing means for providing signals indicating at least two distinct positions of said printing assembly and said cutting mechanism, respectively.

12. A ribbon or tape imprinting apparatus comprising, in combination:

at least two pairs of adjustable guide means for providing a first path for a tape along a first axis;

means for imprinting indicia on a tape including a printing assembly, a platen spaced from and parallel to said printing assembly, means for reciprocably translating said printing assembly along an axis normal to the plane of said platen and means for heating said printing assembly;

first means for advancing the tape along said first axis including a first drive roller, a first friction roller and first means to rotate said first drive roller;

second means for advancing a printing foil generally along a second path normal to said first axis including a second drive roller, a second friction roller, second means for unidirectionally rotating said second drive roller means to adjust the angular rotation of said second drive roller and means responsive to the position of said printing assembly for cycling said second advancing means;

first means for reciprocably translating said printing assembly into imprinting contact with a tape disposed on said platen, control means for cycling said second advancing means; and means for cutting such tape including a first tape cutting mechanism having a first cutting pattern, a second tape cutting mechanism having a second cutting pattern and means for selectively activating said first cutting mechanism or said first and said second cutting mechanisms to cut such tape according to said cutting patterns.

13. The imprinting apparatus of claim 12 wherein said first advancing means includes a stepping motor means for driving said first drive roller.

14. The imprinting apparatus of claim 12 wherein said second advancing means includes a gear rack, a bidirectionally translating means for driving said gear rack bidirectionally, a pinion engaged by said gear rack and an overrunning clutch operably interposed between said pinion and said drive roller.

15. The imprinting apparatus of claim 12 further including a supply of tape and means for sensing the presence of said tape and providing a signal indicating such presence of said tape.

16. The imprinting apparatus of claim 12 further including a supply of foil and means for sensing the supply of foil and providing a signal indicating such presence of said foil.

17. The imprinting apparatus of claim 12 wherein said cutting means further includes a shuttle assembly for mechanically coupling said first cutting mechanism to said translating means and means for sensing the position of said shuttle assembly and providing a signal indicating such position of said shuttle assembly to said sequencing means.

18. The apparatus of claim 12 wherein said printing assembly includes a planar mounting structure having a plurality of positioning projections disposed on one face, at least one type receiving structure having magnetic means for selectively securing said type receiving structure to said planar mounting structure.

19. The imprinting apparatus of claim 12 wherein said imprinting means and said cutting means includes position sensing means for providing signals indicating at least two distinct positions of said printing assembly and said cutting mechanism, respectively.

* * * * *